US009375075B2

(12) United States Patent
Bazan

(10) Patent No.: US 9,375,075 B2
(45) Date of Patent: Jun. 28, 2016

(54) CLIP SYSTEM FOR ATTACHING AN ITEM TO A BELT OR WAISTBAND

(71) Applicant: Sandra Lourdes Bazan, San Diego, CA (US)

(72) Inventor: Sandra Lourdes Bazan, San Diego, CA (US)

(73) Assignee: Sandra Lourdes Bazan, San Diego, CA (US)

( * ) Notice: Subject to any disclaimer, the term of this patent is extended or adjusted under 35 U.S.C. 154(b) by 0 days.

(21) Appl. No.: 14/601,597

(22) Filed: Jan. 21, 2015

(65) Prior Publication Data

US 2016/0143426 A1 May 26, 2016

Related U.S. Application Data

(60) Provisional application No. 62/123,589, filed on Nov. 20, 2014.

(51) Int. Cl.
*A45F 5/02* (2006.01)
*A45C 11/00* (2006.01)

(52) U.S. Cl.
CPC ..... *A45F 5/021* (2013.01); *A45C 11/00* (2013.01); *A45C 2011/002* (2013.01); *Y10T 24/1394* (2015.01); *Y10T 24/3429* (2015.01); *Y10T 24/44368* (2015.01); *Y10T 24/44376* (2015.01); *Y10T 24/44419* (2015.01); *Y10T 24/44521* (2015.01)

(58) Field of Classification Search
CPC ..... A45F 5/02; A45F 5/021; Y10T 24/44521; Y10T 24/1394; Y10T 24/44419; Y10T 24/3429; Y10T 24/44376; Y10T 24/44368
USPC ..... 224/269; 24/3.11, 3.12, 328
See application file for complete search history.

(56) References Cited

U.S. PATENT DOCUMENTS

| | | | | | |
|---|---|---|---|---|---|
| 4,463,482 | A * | 8/1984 | Hawie | A41F 3/02 | 24/489 |
| 5,114,061 | A * | 5/1992 | Brady | A45C 11/22 | 224/194 |
| 5,460,346 | A * | 10/1995 | Hirsch | A45F 5/02 | 224/272 |
| 5,933,922 | A * | 8/1999 | Ochsman | A45F 5/02 | 24/3.11 |
| 6,286,736 | B1 * | 9/2001 | Angus | A45C 1/04 | 224/236 |
| 6,668,432 | B2 * | 12/2003 | Lewis | A41F 3/02 | 24/516 |
| D614,946 | S * | 5/2010 | Herman | D8/395 | |
| 8,157,140 | B2 * | 4/2012 | Jay | A45C 1/06 | 224/269 |
| 8,166,615 | B2 * | 5/2012 | Coldiron | A44B 15/005 | 24/3.11 |
| 8,806,726 | B1 * | 8/2014 | Lo | A61J 17/00 | 24/3.12 |
| 2004/0045133 | A1 * | 3/2004 | Buettell | A45F 5/02 | 24/3.12 |
| 2004/0083580 | A1 * | 5/2004 | Gerson | A47F 5/0884 | 24/3.11 |
| 2014/0250634 | A1 * | 9/2014 | Keum | A41F 17/00 | 24/3.12 |

* cited by examiner

*Primary Examiner* — Justin Larson
(74) *Attorney, Agent, or Firm* — Venable LLP; Toni-Junell Herbert; Aubrey A. Haddach

(57) ABSTRACT

Provided herein is a clip system for attaching an item to a belt or waistband with a suspenders type gripping assembly that includes a pinned rotatable item retaining member.

4 Claims, 9 Drawing Sheets

Belt Clip Assy - Bases
Base - Inner
Base - Outer

.466
.073
.241
1.023
.663
Ø.080
Ø.084
.088
.784
.030
.345
.162
.180
.456
.175
1.093
.428
.536
.030
.445
.110
.114

Belt Clip Assy - Press and Spring
Spring
.48
.16
.04
.079
.40
1.03
.03

Press
R.43
.24
.86
.03
.11
.07
.08
.39
.55

CLIP SYSTEM FOR ATTACHING AN ITEM TO A BELT OR WAISTBAND

CROSS REFERENCE TO RELATED APPLICATIONS

This application claims priority to U.S. Provisional Application No. 62/123,589, filed Nov. 20, 2104, which is incorporated herein by reference in its entirety.

BACKGROUND

This invention relates generally to the field of attachment clips and more specifically to clip system for attaching an item to a belt or waistband.

In today's environment, a great number of people, as they engage in daily activity, carry cell phones in close proximity to their bodies. To accommodate this state of affairs, manufacturers have designed and sold a wide variety of cell phone cases and holders. Some holders come equipped with a spring biased clip that can attach to a user's belt or waistband. Others are sewn cases that may include a carrying strap.

One method of clipping to a belt or waistband is found in standard suspender technology, such as that found in U.S. Pat. No. 5,036,552. The suspender includes clips that have gripping members that can be spread apart during installation onto a waistband and then urged together by pushing down on an external panel causing the gripping members to be forced against one another thereby locking the clip firmly onto the waistband area.

U.S. Pat. No. 8,166,615 discloses a clip that can attach to a person's waistband that uses suspender clip technology and combines a "U shaped" holder to the bottom of one of the gripping members. The U shaped member can be used to attach other items to the clip. For example, claim 1 reads "said first free end being adapted for accepting an attaching member of a disassociated member." Although this patent shows one way to use a suspender type clip to hold an item onto a waistband, it is not the ideal way to accomplish this end.

SUMMARY

One object of the invention described herein is to provide a set of clips that easily attach and detach to a belt or waistband of an article of clothing that allows the user to attach or detach items to the clip such as a cell phone case.

In some embodiments, the clips provided herein allow the item being stored to be easily removed or attached as necessary.

In various embodiments, the clips provided herein employ a rotatable item retaining member to allow removal of the clip without disturbing the item being retained.

In some embodiments, the clips provided herein do not cause irritation to the user's waist area that is in close proximity to the clips.

In accordance with a specific embodiment of the invention described herein, there is disclosed a clip system for attaching an item to a belt or waistband comprising: a pinned rotatable clip release member, a pinned rotatable item retaining member, a first frame member, a second frame member, a first gripping member, a spring biased second gripping member, said first frame member being made of stamped metal and having a flat main body and integral side walls for retaining said second frame member, said second frame member being made of stamped metal and having said first gripping member fixedly attached at its lower end and having opposing side walls with apertures for rotatably retaining said pinned rotatable item retaining member at its upper end, said spring biased second gripping member being made of spring steel and located between said rotatable clip release member and said second frame member, and said rotatable clip release member including a right angle flange capable of sliding to engage said spring biased second gripping member and causing said second gripping member to be forced towards said first gripping member thereby allowing said clip to attach to and be removed from a belt or waistband of an article of clothing.

Other features and advantages of the present disclosure will become more readily apparent to those of ordinary skill in the art after reviewing the following detailed description and accompanying drawings.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

The details of the present disclosure, both as to its structure and operation, may be gleaned in part by the study of the accompanying drawings, in which like reference descriptions refer to like parts and in which.

DETAILED DESCRIPTION

After reading this description it will become apparent to one skilled in the art how to implement the methods and devices of the disclosure in various alternative embodiments and alternative application. However, although various embodiments of the present disclosure will be described herein, it is understood that these embodiments are presented by way of example only, and not limiting.

Figures 1A, 1B:
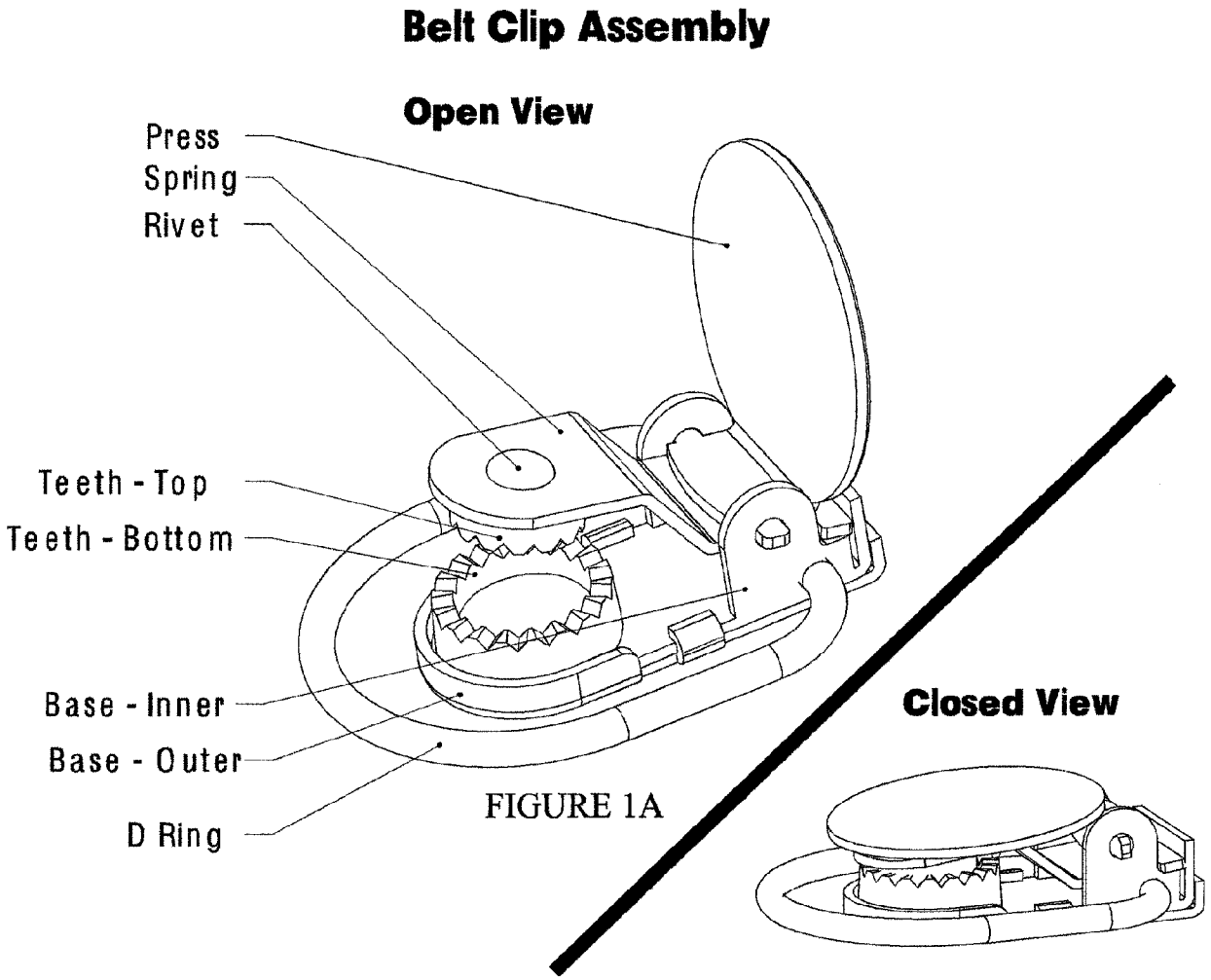
FIG. 1A is a perspective view of the belt clip assembly in the open position, according to one embodiment of the invention described herein.
FIG. 1B is a perspective view of the belt clip assembly in the closed position, according to one embodiment of the invention described herein.
Figures 2A, 2B:
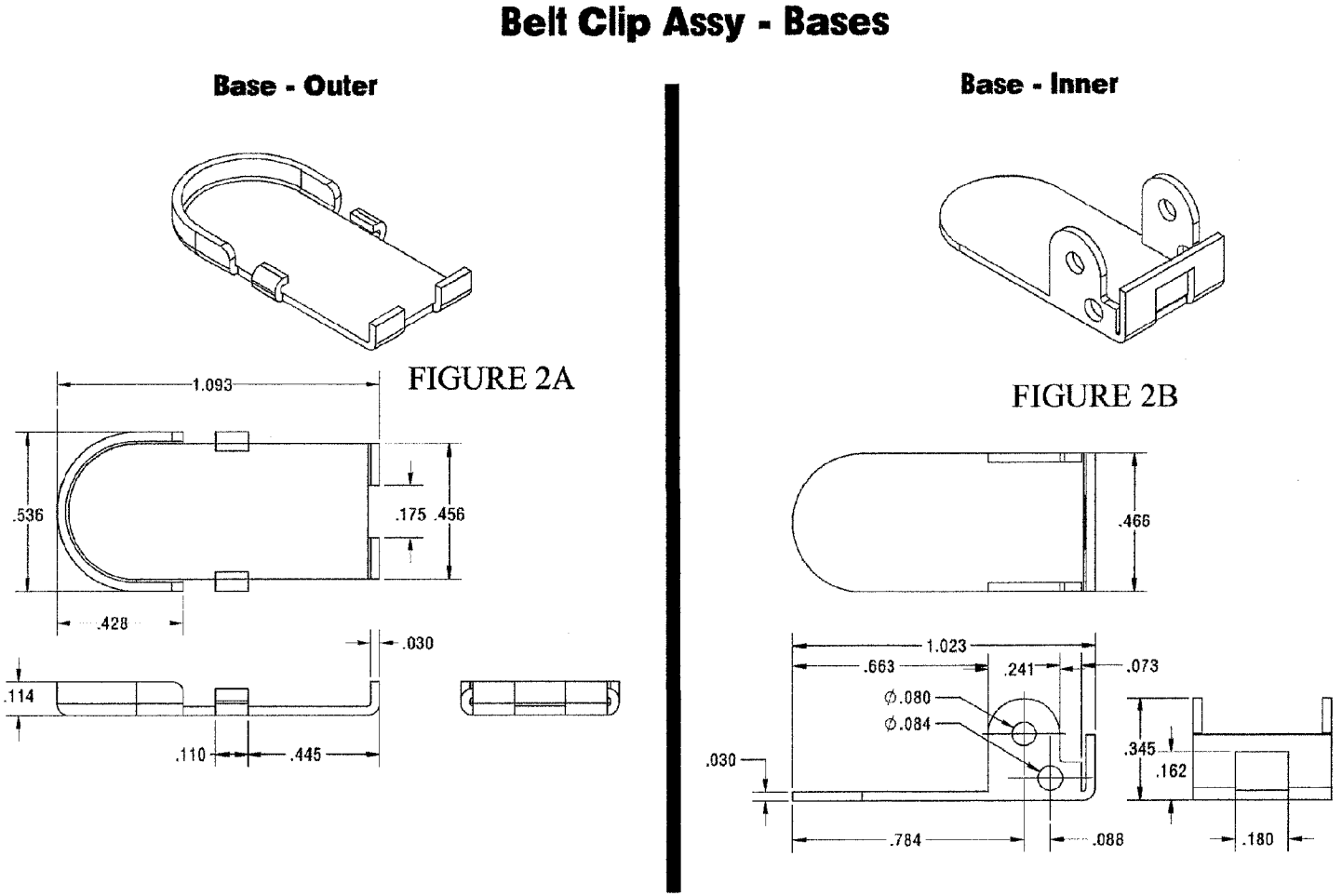
FIG. 2A is a perspective view of the outer base, according to one embodiment of the invention describe herein.
FIG. 2B is a perspective view of the inner base, according to one embodiment of the invention describe herein.
Figures 3A, 3B:
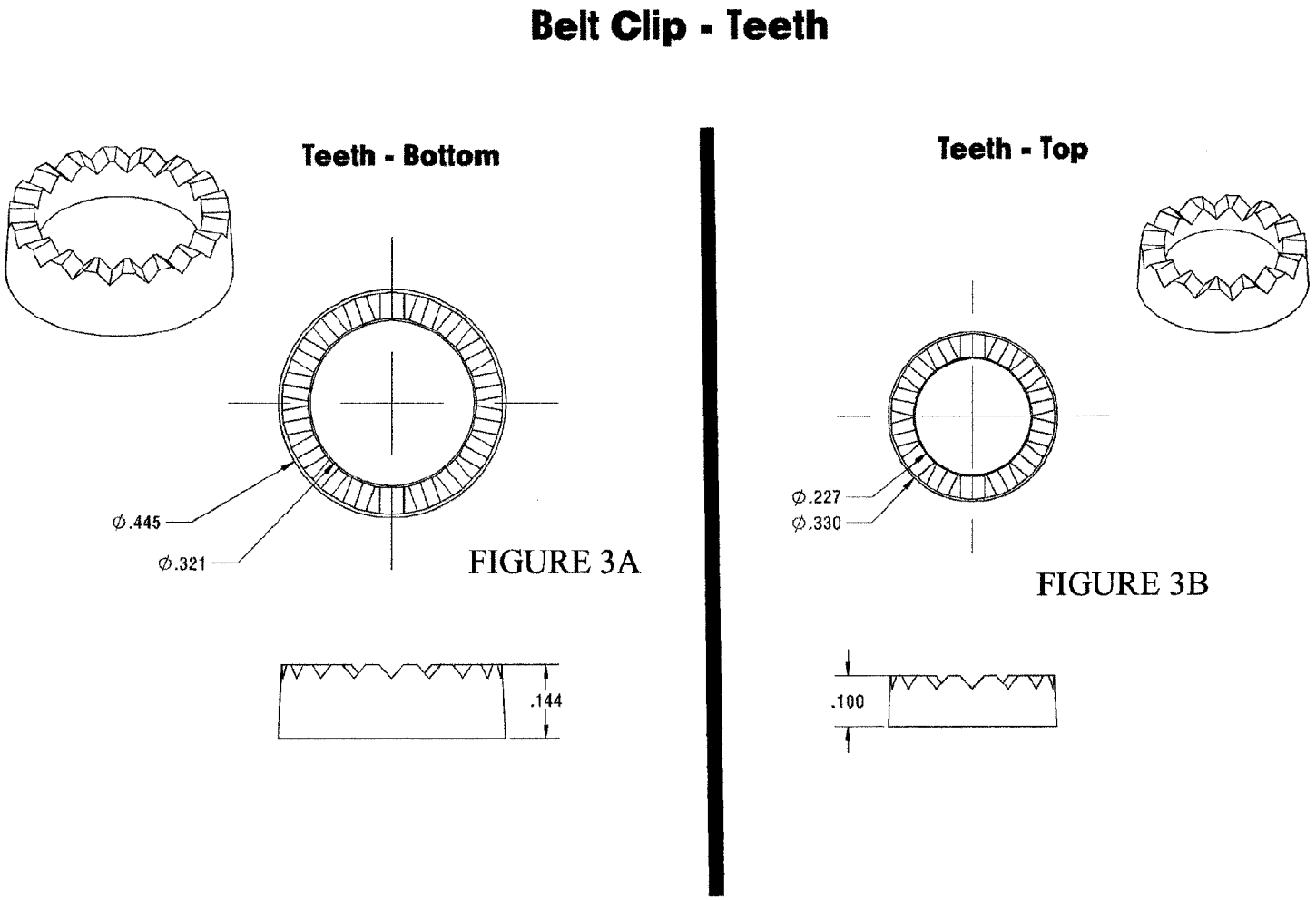
FIG. 3A is a perspective view of the bottom teeth, according to one embodiment of the invention describe herein.
FIG. 3B is a perspective view of the top teeth, according to one embodiment of the invention describe herein.
Figures 4A, 4B:
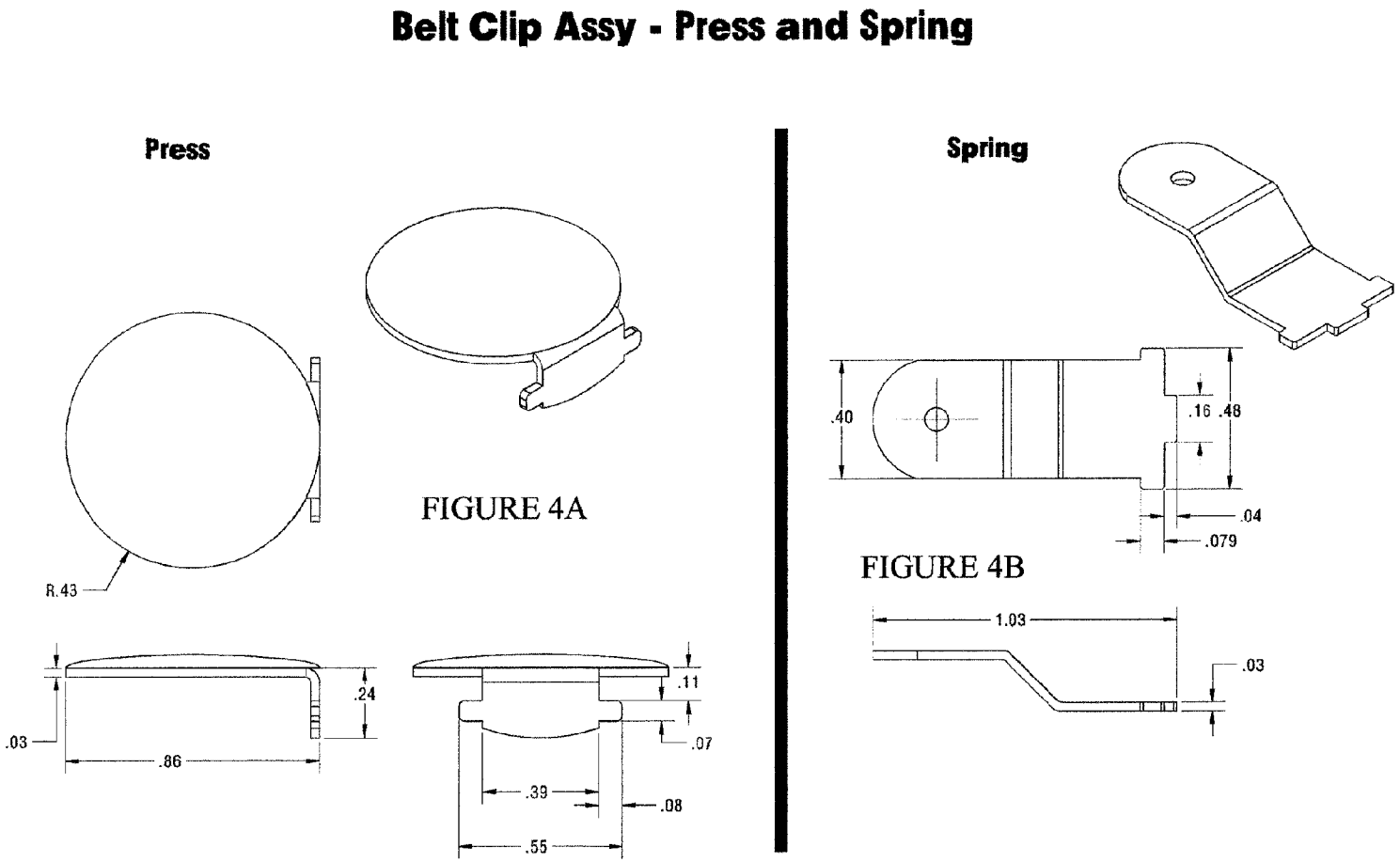
FIG. 4A is a perspective view of the press, according to one embodiment of the invention describe herein.
FIG. 4B is a perspective view of the spring, according to one embodiment of the invention describe herein.
Figure 5:
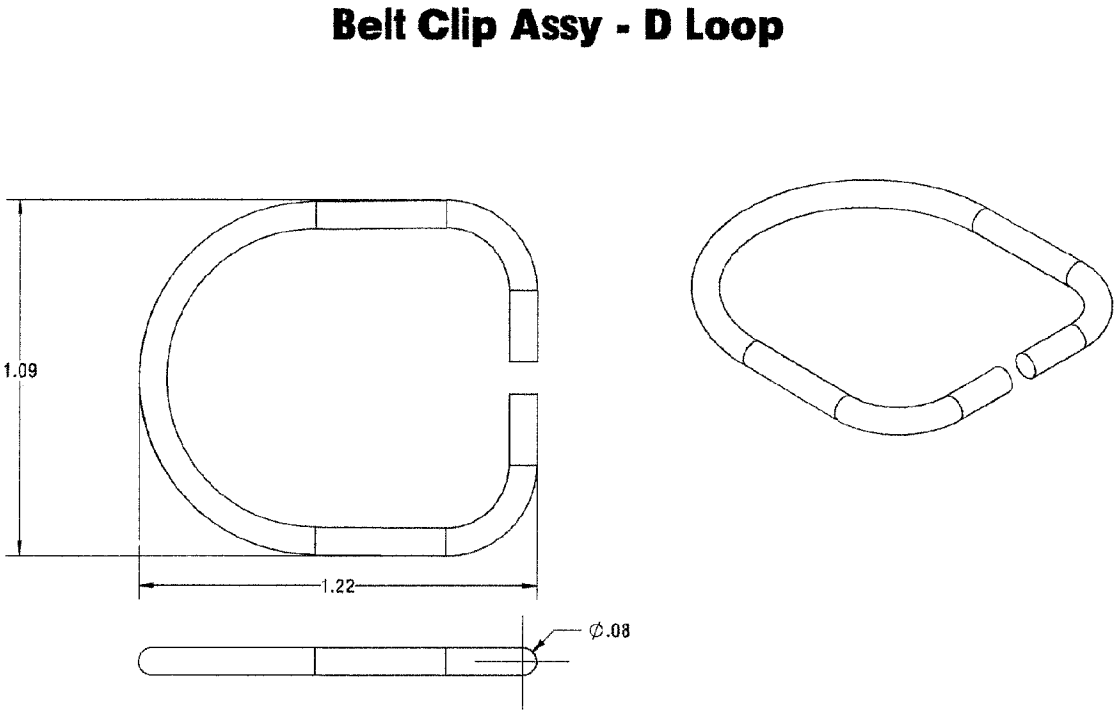
FIG. 5 is a perspective view of the loop, according to one embodiment of the invention describe herein.
Figure 6:
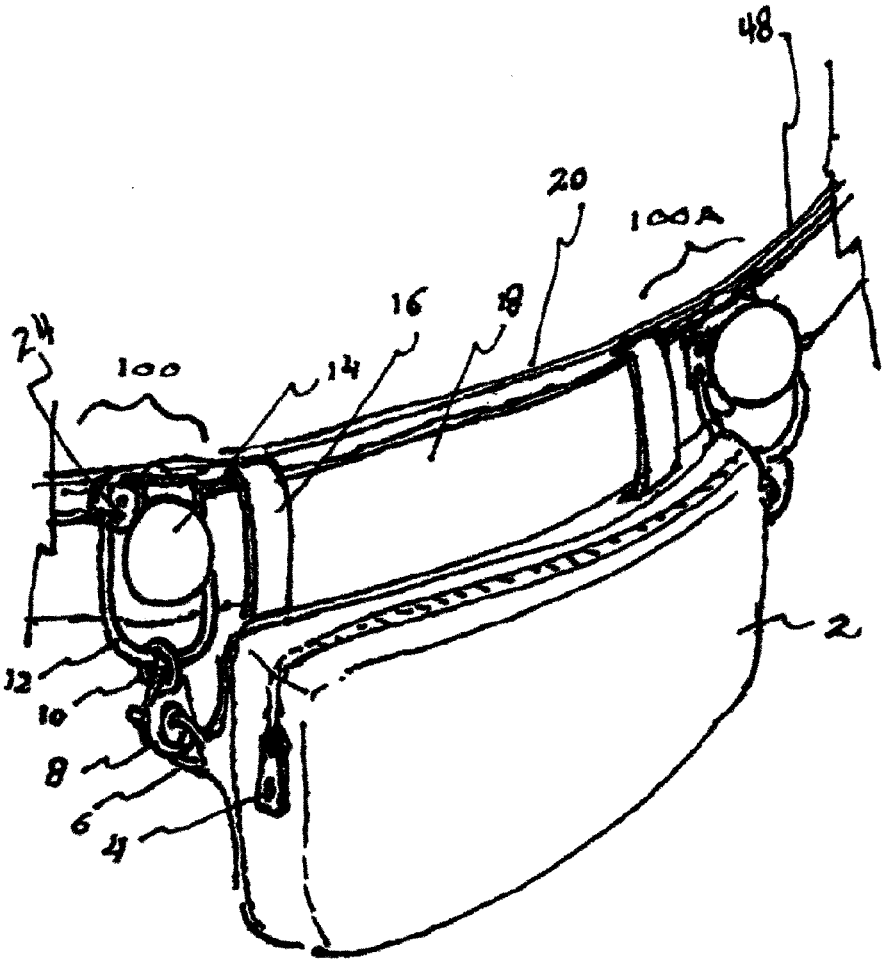
FIG. 6 is a perspective view of the grip system in use according to one embodiment of the invention described herein.

FIG. 6, illustrates a perspective view of the clip described herein in use, [100] and [100A] in use, according to one embodiments of the invention. Clips [100] and [100A] are identical in construction and for the purposes this description, only clip 100 will be referred to when describing the specific design aspects.

The clips 100, 100A attach to a user's belt [18] or waistband [48] of a user's garment. The clips [100] [100A] attach to the belt [18] or garment in a similar way to suspender clips. The clip [100] is released by lifting up on clip release member [14]. The clip [100] includes attachment member [12] that rotatably connects to apertures [34] in the clip [100]. A spring lockable ring [8] attaches via a connector ring [10] to the rotatable attachment member [12]. A sewn on ring [6] is attached to either end of a storage case, in this instance a cell phone case [2], engages the lockable ring [8] causing the case [2] to remain in close proximity to the user's body. Zipper [4] allows quick access to the phone located inside the case [2].

Figure 7:
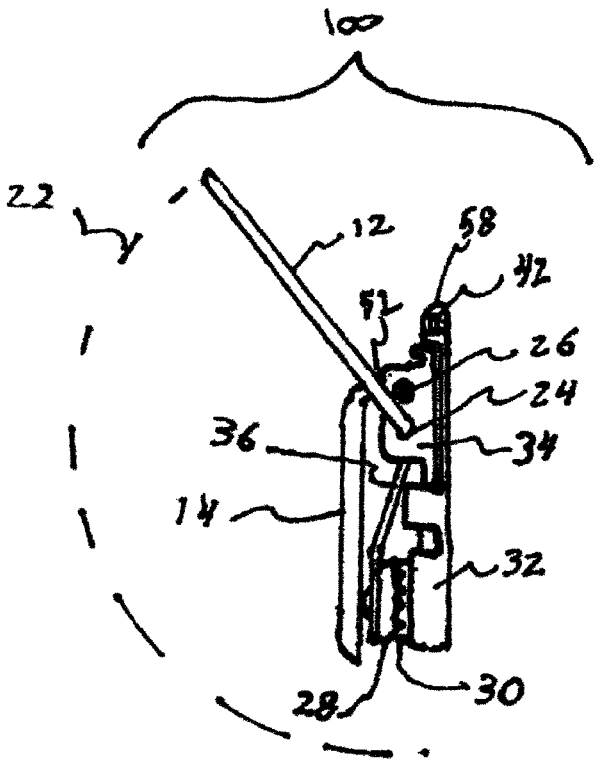
FIG. 7 is a side view of the grip system with the gripping members in the closed position, according to one embodiment of the invention.

FIG. 7 illustrates a side view of the clip [100] in the closed position. Rotatable item retaining member [12] is shown in a raised position to help view the rest of the clamp [100] components. In this embodiment, the item retaining member [12] is in a lowered position as shown by the ending point of arc line [22]. The right angle flange [52] attached to a rotatable clip release member [14] pushes down on spring steel biased second gripping member panel [36] causing second gripping member [28] to be forced against first gripping member [30]. A pants belt or waistband can be trapped between the first gripping member [30] and the second gripping member [28]. In this embodiment, a first frame member [32] is made of stamped metal and retains a second frame member [34]. The second frame member [34] terminates at its bottom end in first gripping member [30] and at its top end in opposed flanges that include apertures [24] [26]. One aperture [24] rotatably retains item holding member [12]. The other apertures [26] rotatably retain shaft pins that extend outward from the top portion of rotatable clip release member [14]. In this embodiment, the top most portion [42] of the clip assembly [100] is rounded [58] and is made of resilient material to decrease the possibility of irritation to the skin in the waist area of the user during use.

Figure 8:
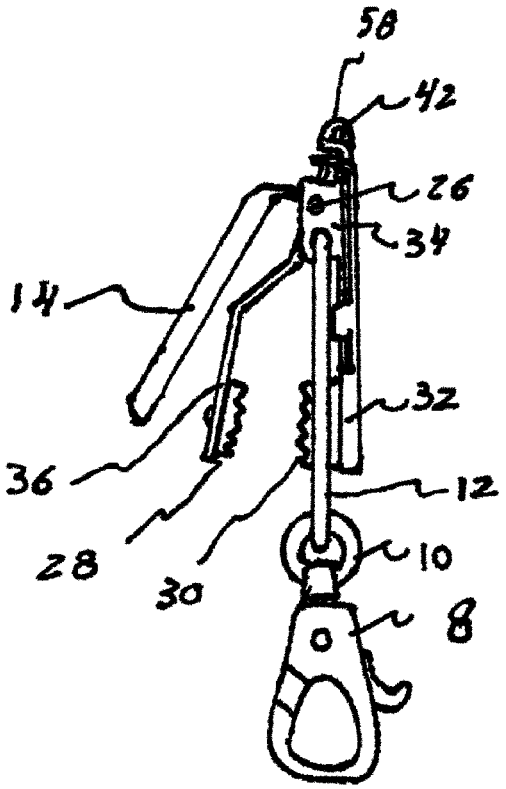
FIG. 8 is a side view of the grip system with the gripping members in the open position, according to one embodiment of the invention.

FIG. 8 is a side view of the clip [100] in the open position. In this embodiment, rotatable clip release member [14] has been lifted up which has removed the force from spring biased second gripping member [36] and second grip piece [28] thereby causing them to spring up and away from grip piece [30]. This allows a person to easily and quickly insert a belt or waistband into the space between grip piece [2]8 and grip piece [30]. Connector ring [10] attaches the item retaining member [12] to the spring lock ring [8].

Figure 9:
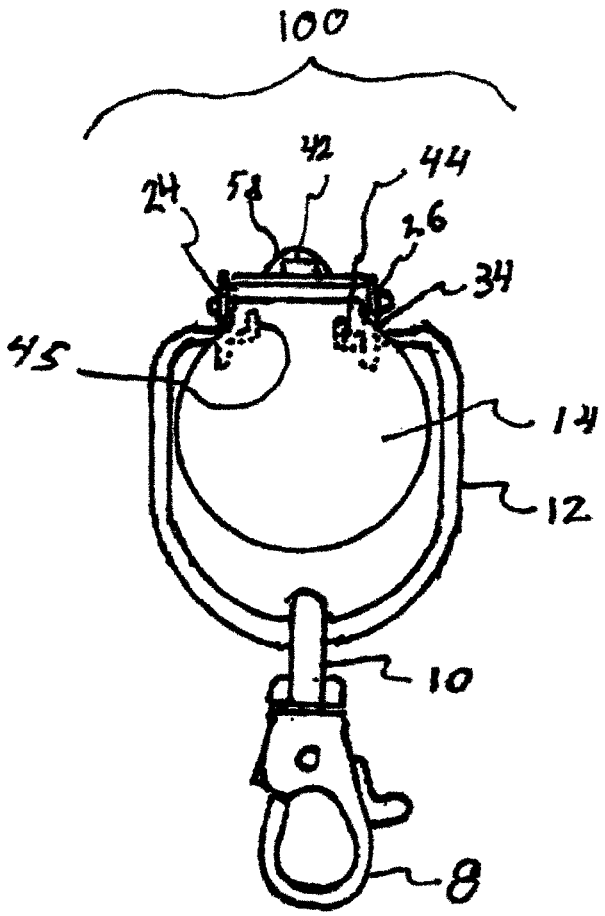
FIG. 9 is a front view of the grip system, according to one embodiment of the invention.

FIG. 9 is a front view of the clip [100]. Rotatable item holding member [12] is shown, including phantom lines [44] [45] which demonstrate how the ends of the item holding member [12] terminate in an L shape to insure that they remain fixed within the boundaries of opposing flanges [24] [26]. In this embodiment, tab [42] extends from the top portion of second frame member [34] as also shown in FIG. 7. This tab [42] is the fulcrum point for the flexing of spring biased second gripping member [36], allowing it to rotate from the closed position as shown in FIG. 7 to the open position as shown in FIG. 8.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A clip system for attaching an item to a belt or waistband comprising:

a pinned rotatable clip release member; a pinned rotatable item retaining member; a first frame member; a second frame member; a first gripping member; and a spring biased second gripping member;

wherein: the first frame member is made of stamped metal and has a flat main body and integral side walls for retaining said second frame member; the second frame member is made of stamped metal and has the first gripping member fixedly attached at its lower end and having opposing side walls with apertures for rotatably retaining said pinned rotatable item retaining member at its upper end; the spring biased second gripping member being made of spring steel and located between said rotatable clip release member and said second frame member; and the rotatable clip release member including a right angle flange capable of slidably engaging said spring biased second gripping member and causing said second gripping member to be forced towards said first gripping member thereby allowing said clip to removably attach to a belt or waistband of an article of clothing.

2. The clip system of claim 1, wherein a pair of said clips are spaced apart from each other while attached to said belt or waistband and each have standard spring biased locking rings that each attach to each said pinned rotatable item retaining member.

3. The clip system of claim 2, wherein the standard spring biased locking rings can engage mating rings located on each side of a sewn case.

4. The clip system of claim 3, wherein the sewn case is sized to removably retain a standard cell phone.

* * * * *